United States Patent [19]

Hübner et al.

[11] Patent Number: 4,786,661

[45] Date of Patent: Nov. 22, 1988

[54] PROCESS FOR THE RAPID DISSOLUTION OF WATER-SOLUBLE POLYMERS

[75] Inventors: Wolfgang Hübner, Möhlenring; Helmut Klein, Zu den Tannen; Erhard Goldacker, Am langen Bruchbach; Otto Schroer, Dohrhofweg, all of Fed. Rep. of Germany

[73] Assignee: Chemische Fabrik Stockhausen GmbH, Krefeld, Fed. Rep. of Germany

[21] Appl. No.: 518,511

[22] Filed: Jul. 29, 1983

[30] Foreign Application Priority Data

Aug. 2, 1982 [DE] Fed. Rep. of Germany ..... 3228843

[51] Int. Cl.[4] ..... C06L 31/00

[52] U.S. Cl. ..... 523/318; 523/336

[58] Field of Search ..... 528/499; 524/555; 523/332, 339, 318, 336

[56] References Cited

U.S. PATENT DOCUMENTS

| | | | |
|---|---|---|---|
| 3,282,874 | 11/1966 | Friedrich et al. | 524/557 |
| 4,051,065 | 9/1977 | Venema | 252/359 A |
| 4,217,145 | 8/1980 | Gaddis | 106/170 |

*Primary Examiner*—Amelia Burgess Yarbrough

*Attorney, Agent, or Firm*—Sprung Horn Kramer & Woods

[57] ABSTRACT

A process is disclosed for the rapid dissolution of water-soluble polymers in water, in that water in a finely divided state is introduced under pressure into the prepared finely divided polymer. The water-soluble polymer can be in the form of a water-in-oil emulsion or the form of a powder-in-oil suspension; the water is preferably introduced under pressure through a nozzle and tangentially to the surface of the prepared polymer.

6 Claims, No Drawings

PROCESS FOR THE RAPID DISSOLUTION OF WATER-SOLUBLE POLYMERS

This invention relates to a process for the rapid dissolution of water-soluble polymers.

Water-soluble synthetic or natural polymers are used for a great variety of technical purposes. Of these, their use in the paper industry in the form of highly diluted aqueous solutions for flocculation, sedimentation, as well as for retention agents is especially well-known.

The production of aqueous solutions of these polymers, proceeding from commercial powdered products, is difficult. When the finely divided powder comes into contact with water, swollen particles result, and this hinders further dissolution, or renders it extremely difficult. Although water-soluble in and of themselves, the solid polymers only disperse poorly in water, and tend to form lumps and agglomerates. In order to hinder the formation of such lumps or agglomerates or to finally break up aggolomerates that have been formed, it is necessary to stir intensively, and this requires considerable shearing force. However, shearing forces of such magnitude damage the polymers in that they break down the polymer chains so that the polymers lose their effectiveness, for example, as flocculation agents, either partially or totally.

Attempts have already been made to dissolve such polymer powders by indirect methods. Thus, in U.S. Pat. No. 3,282,874 the polymers powders are first dispersed in an organic phase that is not soluble in water and then this dispersion is processed into a water-in-oil emulsion. This emulsion separates into an organic phase and an aqueous phase, which contains an aqueous polymer gel. However, this gel, too, can only be processed into a diluted polymer solution by intensive stirring, i.e. by the application of shear forces that damage the polymers. The process used to produce the diluted polymer solutions is complex quite apart from this.

In German Pat. No. 2,154,081 rapid dissolution of the polymers without the use of intensive or lengthy stirring is achieved in that a water-in-oil emulsion of the polymers of a specific nolecular weight of over one million and of a specific size between 5 nm and 5μm produced by emulsion polymerisation of the corresponding monomers, is poured into water in the presence of a hydrophilic wetting agent such that the water-in-oil emulsion is converted to an oil-in-water emulsion.

After the water-in-oil emulsion of the polymers has been stirred into the prepared water, the aqueous polymer solution still requires a specific maturation time in order to reach optimal effectiveness for technical applications. The procedure described in German Pat. No. 2,154,081 is based on the application of the known phase inversion in the presence of a wetting agent to known water-in-oil polymer emulsions, which, for example, can be obtained by the polymerisation process described in U.S. Pat. No. 3,284,393. It is also important that for the dissolution process according to German Pat. No. 2,154,081 the polymer emulsion be added to the water (and not the reverse), as is also the presence of a wetting agent when the polymer emulsion is added to the water. It is only when both these conditions are met that the desired rapid dissolution will be achieved. If the reverse procedure is followed, and water is added to the water-in-oil emulsion of the polymers, there is no rapid dissolution. On the contrary, there has to be intensive stirring to effect dissolution. Only infrequently does one achieve rapid dissolution if the polymer emulsion is added to the water without the presence of a wetting agent.

It has now been found that rapid dissolution of the polymers can be achieved if the water required for dissolution is introduced into the prepared finely-divided polymer under pressure.

In view of the following difficulties, it is surprising that the mode of operation according to the present invention is successful.

When water is first added to prepared polymers in powder form, a superficially wetted cake or lump is formed, and this contains still-dry powder on the inside, whereas the surface consists of swollen polymer particles, i.e., those that contain water. Such an agglomerate can only be dissolved with difficulty without the use of additional aids, such as intensive stirring. When a water-in-oil emulsion of the polymers or a suspension of the powder product in an oil phase is used, if the emulsion or suspension or the water that is added contains the wetting agent needed to bring about the inversion, immediately after the start of the addition of the water a situation will arise in which little water will contact a great deal of polymer. The presence of the hydrophilic wetting agent activates or brings about, respectively, the phase inversion. A sudden increase in viscosity occurs, brought about by the phase inversion and the rapid dissolution of the polymer. The viscosity of the solution increases from the viscosity of a thin liquid or from low viscosity to that of a stiff, rubber-like gel that for practical purposes can no longer be manipulated, and this occurs very quickly. The prepared polymer thickens to such gel and can only be moved in the vessel by the use of a large shear forces that are detrimental to the polymer because of chain breakdown, and can only be got into solution by the addition of much more water and intensive application of shear forces. It is thus surprising that when water is introduced in finely divided form at high pressure this rapid increase in viscosity to a practically unmanageable gel does not take place.

The invention provides a process for the rapid dissolution of water-soluble polymer in water, characterized in that water in a finely divided state and under pressure is introduced into the prepared, finely divided polymer.

The mode of operation according to the present invention is also surprising in light of U.S. Pat. No. 4,217,145, from which it is known that a polymer emulsion can be mixed with water for the rapid formation of a highly viscous liquid. This occurs in that water and polymer emuision are mixed with each other, whereupon the mixture is passed through a nozzle, i.e., a zone of reduced flow cross-section, at a pressure of approximately 1 to 20 atmospheres, the mixture then being released into a zone of turbulent flow, powerful stirring being effected in this tubulent zone, the mixture finally being drawn off from the turbulent zone into a settling zone. The procedure according to U.S. Pat. No. 4,217,145 is comparatively complex and requires several process stages.

It is surprising that in the mode of operation according to the present invention, particularly with the use of a water-in-oil emulsion of the polymer during the addition of the water, no breakup or other effects occur, but that obviously the water-in-oil emulsion can be rapidly changed to a water-in-oil-in-water emulsion.

The water is best introduced at a pressure of at least 20, preferably 25, particularly 50 to 80 bar. In this regard it has proved to be particularly advantageous to introduce the water tangentially to the surface of the prepared polymer, since this results in particularly good mixing.

For purposes of the invention water soluble synthetic or natural products are suitable as the polymers, for example, polymers and copolymers of acrylic acid, acrylamides, methacrylic acid, methacrylamides, vinylpyrrolidone, acrolein, quaternary ammonium salts that contain vinyl groups, as well as natural rubbers. Such products are available as either powders or water-in-oil emulsions.

Known products are also suitable as the hydrophilic wetting agents that convert the water-in-oil emulsion or the suspension of the powder polymers in oil to an oil-in-water emulsion. The wetting agent that is used is hydrophilic and water-soluble. It is used in quantities from 0.01 to 20% in relation to the polymer, whereby, for all practical purposes, quantities of wetting agent from 1.0 to 10% are sufficient.

The following can be used as wetting agents: oxethylated alkylphenols, e.g., nonylphenol-9-EO, sodium or potassium soaps of the higher fatty acids, fatty alcohol sulfates, alkylsulfonates, alkylarylsulfonates, sulfated and sulfonated oil, e.g., sulfated castor oil, etc.

The wetting agent can be added either at the conclusion of the addition of water or shortly before this, either separately or together with the water that is added in a jet, as well as by incremental quantities.

The present invention is described in greater detail in the following example.

EXAMPLE 1

1.2 kg of an anionic 25% E-polymer (of 65 mol-% acrylamide and 35 mol-% Na-acrylate) was added to a 120 l polyethylene dissolving tank. The emulsion polymer already contained the wetting agent for the phase inversion. The product was dissolved rapidly by the addition of water, in that 19.8 l of water were added continuously to the liquid E-polymer through the injection nozzle of a high-pressure spray device (Kaercher, Type HDS 800) that delivered water at a pressure of 80 bar. The water that was added under pressure mixed with the E-polymer, phase inversion of the emulsion took place, and the polymer went into solution, the viscosity increasing sharply. The viscous solution was diluted to a homogenous 0.3% solution with a viscosity of 800 mPa.s (Brookfield, 20 deg.C) by the addition of more water under pressure. The process lasted 5 minutes.

A subsequent flocculation test carried out on an aqueous clay suspension (18 g blue Witterschlick clay/liter resulted in a flocculation value of 4 seconds for the addition of 1 ppm of the polymer.

EXAMPLE 2

1.2 kg of an anionic 25% E-polymer as in Example 1 was dissolved by the Process described in Example 1; however, 10 l of water were added to the prepared product that was then immediately dissolved by the addition of 88.8 l of water through an injection nozzle at a pressure of 80 bar. After some 4 mintues a homogenous 0.3% solution of the polymer with a viscosity of 800 mPa.s was obtained.

A subsequent flocculation test carried out on an aqueous clay suspension (18 g blue Witterschlick clay/liter resulted in a flocculation value of 4 seconds for the addition of 1 ppm of the polymer.

EXAMPLE 3

2,406 kg of a cationically effective 37.4% E-polymer (proportion of cationic groups 70%-wt), that contained an activator for phase inversion were placed in a 0.5 $m^3$ dissolving tank. In order to produce a 0.3% solution, 297.3 l of water at a pressure of 18 bar were added through 4 nozzles arranged tangentially to the surface of the liquid, 25 cm above the bottom of the tank on a water feedline, and at the same time some of the water was fed in from above through a fall pipe. A 0.3% solution of the polymer in water, with a viscosity of 440 mPa.s was formed.

A subsequent flocculation test carried out on an aqueous clay suspension (18 g Witterschlick blue clay/liter resulted in a flocculation value of 5 seconds for the addition of 2 ppm.

We claim:

1. A process for the rapid dissolution of water-soluble polymer in water, comprising introducing water alone or mixed solely with a hydrophilic wetting agent in finely divided state under pressure into a water-in-oil emulsion of the polymer or into a suspension of the polymer powder in oil, at least one of the water-in-oil emulsion, the powder-in-oil suspension of the polymer and the water that is introduced containing a hydrophilic wetting agent.

2. A process according to claim 1, wherein the water added is under a pressure of at least about 18 bar.

3. A process according to claim 1, wherein the water added is under a pressure of about 20 to 80 bar.

4. A process according to claim 1, wherein the water added is under a pressure of about 50 to 80 bar.

5. A process according to claim 1, wherein the water is introduced tangentially to the surface of the emulsion or supsension.

6. A process according to claim 1, wherein the water is introduced in a quantity required for the production of a dilute aqueous solution of a concentration of 0.01 to 1%-wt.

* * * * *